US007315121B2

(12) United States Patent
Hirakawa et al.

(10) Patent No.: US 7,315,121 B2
(45) Date of Patent: Jan. 1, 2008

(54) ARC TUBE ARRAY-TYPE DISPLAY DEVICE AND DRIVING METHOD THEREOF

(75) Inventors: Hitoshi Hirakawa, Kawasaki (JP); Manabu Ishimoto, Kawasaki (JP); Kenji Awamoto, Kawasaki (JP)

(73) Assignee: Shinoda Plasma Corporation, Kobe (JP)

( * ) Notice: Subject to any disclaimer, the term of this patent is extended or adjusted under 35 U.S.C. 154(b) by 0 days.

(21) Appl. No.: 11/386,693

(22) Filed: Mar. 23, 2006

(65) Prior Publication Data

US 2006/0170327 A1 Aug. 3, 2006

Related U.S. Application Data

(63) Continuation of application No. PCT/JP03/15365, filed on Dec. 1, 2003.

(51) Int. Cl.
*H01J 17/49* (2006.01)
*H01J 1/62* (2006.01)

(52) U.S. Cl. ..... 313/582; 313/484

(58) Field of Classification Search ..... 313/484–486, 313/607, 582–587

See application file for complete search history.

(56) References Cited

U.S. PATENT DOCUMENTS 6,836,063 B2 * 12/2004 Ishimoto et al. ..... 313/484

FOREIGN PATENT DOCUMENTS

| | | |
|---|---|---|
| JP | 9-90899 | 4/1997 |
| JP | 2000-331615 | 11/2000 |
| JP | 2003-45375 | 2/2003 |
| JP | 2003-86141 | 3/2003 |
| JP | 2003-86142 | 3/2003 |
| JP | 2003-92085 | 3/2003 |
| JP | 2003-316313 | 11/2003 |

* cited by examiner

*Primary Examiner*—Joseph Williams
(74) *Attorney, Agent, or Firm*—Staas & Halsey LLP

(57) ABSTRACT

An arc tube array-type display device includes an arc tube array, a supporting member, a plurality of display electrodes, a plurality of scan electrodes, and a plurality of address electrodes. The arc tube array has a plurality of arc tubes arranged side by side. Each of the arc tubes has a discharging gas sealed therein. The supporting member supports the arc tube array. The plurality of display electrodes are arranged at an adjacent portion between the arc tubes, and generate an opposing discharge inside the arc tube by applying voltages to each of the arc tubes from both of the side faces. The plurality of scan electrodes are arranged on the display surface side of the arc tube in a stripe form in a direction intersecting the longitudinal direction of the arc tube so as to form light-emitting areas at intersecting portions against the arc tubes. The plurality of address electrodes are used for selecting light-emitting areas arranged on the back surface side of the respective arc tubes.

4 Claims, 10 Drawing Sheets

ARC TUBE ARRAY-TYPE DISPLAY DEVICE AND DRIVING METHOD THEREOF

This application is a continuation application, filed under 35 USC 111(a), of International Application PCT/JP2003/015365, filed Dec. 1, 2003.

FIELD OF THE INVENTION

The present invention relates to an arc tube array-type display device and its driving method, and more particularly concerns an arc tube array-type display device in which a plurality of arc tubes (also referred to as "display tube" and "gas discharge tube"), each formed of a thin tube of about 0.5 to 5 mm in diameter in which a phosphor layer is placed with a discharge gas sealed therein, are aligned in parallel with one another to display a desired image, and its driving method.

BACKGROUND ART

With respect to the arc tube array-type display of this type, those disclosed in Japanese Patent Application Laid-Open No. 2003-86141 and Japanese Patent Application Laid-Open No. 2003-86142 have been known. FIGS. 17 and 18 show these examples. FIG. 18, which is a partial cross-sectional view of FIG. 17, shows a state in which a display device is cut in a direction orthogonal to the length direction of the arc tube of a display device.

In this arc tube array-type display, a display panel is constituted by a number of arc tubes 1 (arc tube array) aligned in parallel with one another, which are sandwiched by a pair of flat-plate supporting members 31 and 32 made of glass, resin, or the like. Moreover, another structure has been known in which transparent film sheets are used as the supporting members. In the arc tube 1, a red phosphor layer R, a green phosphor layer G and a blue phosphor layer B are placed, with a discharge gas being sealed therein.

In the display device of this type, a discharge is generated inside the arc tube, and electrodes used for discharging are formed on arc tube array opposing faces of the supporting members, with the electrodes being made in contact with the surface of the arc tube.

With respect to these electrodes, normally, address electrodes (also referred to as data electrodes) A are arranged along each of arc tubes on the arc tube array opposing face of the supporting member 32 on the back surface side, and a number of paired display electrodes X and Y, used for face-discharging, are arranged on the arc tube array opposing face of the supporting member 31 on the front surface side (display surface side) in a direction intersecting the address electrodes A. Each of the display electrodes is formed by a transparent electrode 12 made of an ITO film or a $SnO_2$ film or the like and a bus electrode 13 made of a metal film. Each of the address electrodes A is made of a metal film.

Upon conducting a display process, the Y electrodes of the paired display electrodes are used as electrodes for scanning, and a light-emitting area is selected by generating an address discharge at an intersecting portion between the Y electrode and the address electrode A. Next, by utilizing a wall charge formed on the tube inner face of the corresponding area by the address discharge, a display discharge (also referred to as a holding discharge or a sustain discharge) is generated at the paired electrodes X and Y so that the displaying process is carried out. Thus, as indicated by an arrow in FIG. 18, red light 33, green light 34 and blue light 35 are emitted from the arc tube 1. The address discharge is an opposing discharge generated inside the arc tube 1 between the Y electrode and the address electrode A that face each other with the arc tube 1 being sandwiched in between, and the display discharge is a face discharge generated inside the arc tube 1 between the two display electrodes X and Y that are placed on the plane in parallel with each other. With this electrode layout, a plurality of light-emitting areas (unit light-emitting area) are formed in the length direction of the arc tube.

In the arc tube array of this electrode layout, however, since the display discharge is prepared as a face discharge, a high discharging voltage is required. Moreover, the phosphor layer is formed on the back surface side of the inside of the arc tube, and since the area of the face discharge is apart from this phosphor layer, vacuum ultraviolet rays to be used for exciting are not sufficiently supplied to the phosphor layer. Moreover, since two display electrodes are placed at a single light-emitting area on the front surface side of the arc tube array, the light-shielding rate becomes greater, resulting in a low light-emitting efficiency.

Moreover, due to irregularities caused by deviations in the tube diameter of the arc tubes or the like, an insufficient adhesion between the display electrode and the arc tube tends to occur to cause deviations in the discharge starting voltage for each of the light-emitting areas, resulting in problems of a failure to ensure a large operational margin and the like.

Here, in the case of a PDP (Plasma Display Panel) of a type in which cells are formed by separating a discharge space formed between the pair of substrates using partition walls, which is different from the structure of the above-mentioned arc tube array-type display device, a PDP described in Japanese Patent Application Laid-Open No. 2000-331615 has been known as a patent relating to the present invention. This PDP has a structure in which display electrodes are arranged on a side face of each of partition walls.

The present invention has been devised in consideration of such circumstances, and scan electrodes and paired display discharging electrodes are installed in a separate manner so that the paired display discharging electrodes are installed on the side face of the arc tube to provide a four-electrode structure; thus, the discharging voltage can be reduced and the light-emitting efficiency can be improved.

DISCLOSURE OF THE INVENTION

The present invention provides an arc tube array-type display device comprising: an arc tube array in which a plurality of arc tubes are arranged side by side, each of the arc tubes having a discharging gas sealed therein; a supporting member that is made in contact with at least one of a display surface side and a back surface side of the arc tube array so as to support the arc tube array; a plurality of display electrodes that are arranged at an adjacent portion between the arc tubes, and generate an opposing discharge inside the arc tube by applying voltages to each of the arc tubes from both of the adjacent portions; a plurality of scan electrodes that are arranged on the display surface side of the arc tube in a stripe form in a direction intersecting the longitudinal direction of the arc tube so as to form light-emitting areas at intersecting portions against the arc tubes; and a plurality of address electrodes used for selecting light-emitting areas arranged on the back surface side of the respective arc tubes.

The present invention also provides a driving method of an arc tube array-type display device as described above.

The driving method includes the steps of: upon displaying an image on a screen, using one frame constituted by a plurality of sub-fields having different luminances, with each sub-field being constituted by a reset period in which charges of all the light-emitting areas are initialized, an address period in which a light-emitting area to be allowed to emit light is selected and a sustain period in which the selected light-emitting area is made to emit light; applying, in the reset period, a voltage pulse to all the electrodes so that discharges are generated in all the light-emitting areas; successively applying, in the address period, a scanning pulse to the scan electrodes, while an address pulse is applied to desired address electrodes so that an address discharge is generated between each scan electrode and each address electrode, with a wall charge being accumulated within the light-emitting area to be made to emit light; and alternately applying, in the sustain period, a sustain pulse between the display electrodes opposing to each other with an arc tube being interposed therebetween so that a sustain discharge is generated within the arc tube to display an image on the screen, wherein the reset period is constituted by a writing period and a charge compensating period, in the writing period, discharges are generated between the scan electrode and the address electrode as well as between the two display electrodes opposing to each other with the arc tube interposed therebetween so that a residual charge is eliminated while a new charge is formed, and in the charge compensating period, discharges are generated to set the charge formed during the writing period to a state suitable for the next address discharge.

In accordance with the present invention, the discharge between the display electrodes is prepared as an opposing discharge. Therefore, in comparison with an arc tube array-type display device in which the discharge between the display electrodes is prepared as a face discharge, the discharge voltage between the display electrodes can be lowered, and the number of electrodes to be placed on the display surface side of the arc tube array can be reduced, so that the shielding rate of light projected from the arc tube array can be lowered. Thus, by utilizing the low discharge voltage and the low light shielding rate, it becomes possible to provide a superior arc tube array-type display device with a high lumina:nce and a superior light-emitting efficiency.

BEST MODE FOR CARRYING OUT THE INVENTION

Figure 1:
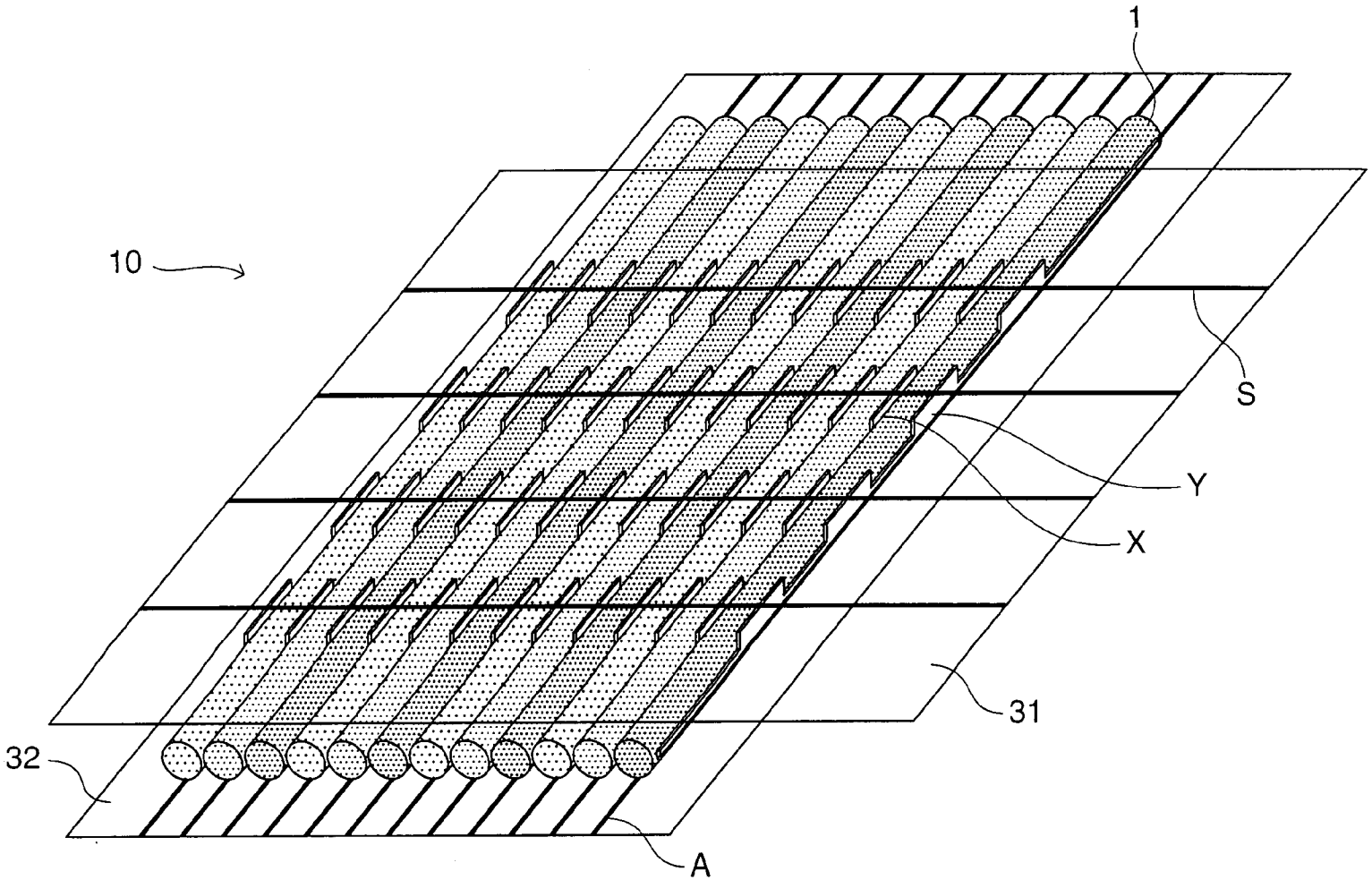
FIG. 1 is an explanatory drawing that shows the entire structure of an arc tube array-type display device in accordance with the present invention.

In the arc tube array-type display device of the present invention, any arc tube array may be used as long as it has a structure in which a plurality of arc tubes, each having a discharge gas sealed therein, are arranged side by side. With respect to a thin tube that forms the tube body of the arc tube, any thin tube having any diameter may be used, and preferably, those tubes having a diameter in a range from 0.5 to 5 mm, made of glass, are adopted. With respect to the shape of the thin tube, any sectional shape, such as a round shape in its section, a flat elliptical shape in its section and a rectangular shape in its section, may be used.

With respect to the supporting member, any member may be used as long as it is made in contact with at least one of the display surface side and the back surface side of the arc tube array, and can support the arc tube array. For example, a flexible sheet made of resin and a substrate made of glass may be used as the supporting member. With respect to the flexible sheet made of resin, for example, a light-transmitting film sheet and the like may be used. With respect to the film used for this film sheet, commercial PET (polyethylene terephthalate) films and the like may be adopted. With respect to the substrate made of glass, for example, a substrate made of soda lime glass may be used.

With respect to the supporting member, preferably, a pair of supporting members, which can support the arc tube array from both of the display surface side and the back surface side, are used. In this case, it is not necessarily required to make both of the members by using the same material, and, for example, one of them is made of resin, while the other is made of glass; thus, any desired structure may be adopted.

The size of the supporting member is preferably set to a size that can cover virtually the entire portion of the arc tube array with a sheet shape or a flat-plate shape, so as to support the entire arc tube array.

With respect to the display electrode, any electrode may be used as long as at an adjacent portion between the arc tubes, and allowed to apply voltages to each arc tube from both of the side faces so that an opposing discharge can be generated in the arc tube.

These display electrodes may be formed by using various materials known in the corresponding field. With respect to the material used for the electrodes, examples thereof include: transparent conductive materials, such as ITO and $SnO_2$, and metal conductive materials, such as Ag, Au, Al, Cu and Cr. With respect to the method of forming the electrodes, various methods known in the corresponding field may be used. For example, the electrodes may be formed by using a thick-film forming technique, such as printing, or a thin-film forming technique, such as a physical deposition method or a chemical deposition method. With respect to the thick-film forming technique, for example, a screen printing method may be used. Of the thin-film forming techniques, with respect to the physical deposition method, for example, a vapor deposition method and a sputtering method may be used. With respect to the chemical deposition method, methods, such as a thermal CVD method, a photo-CVD method or a plasma CVD method, may be used.

The display electrodes may be formed on outer wall faces on both of the sides of the arc tube, or may be formed on one of outer wall faces of the arc tube so that adjacent arc tubes commonly possess one display electrode positioned between them.

The display electrode is preferably constituted by a thick electrode portion corresponding to a portion of a light-emitting area and a thin electrode portion corresponding to a non-light-emitting area. In this case, the thin electrode portion is preferably formed at a portion closer to the back surface of the arc tube array.

With respect to the scan electrode, any electrode may be used as long as the electrodes are arranged in a stripe format on the display surface side of the arc tube in a direction intersecting the length direction of the arc tube so as to form a light-emitting area at an intersecting portion against the arc tube. From the viewpoint of easiness in formation, the scan electrodes are preferably formed on the face of the supporting member opposing to the arc tube, which is placed on the display surface side of the arc tube array.

With respect to the address electrode, any electrode may be used as long as the electrodes are arranged on the back surface side of the respective arc tubes, for use in selecting the light-emitting area. Each of these address electrodes is preferably constituted by a thick electrode portion corresponding to the portion of the light-emitting area and a thin electrode portion corresponding to the portion of the non-light emitting portion. From the viewpoint of easiness in formation, the address electrodes are preferably formed on the face of the supporting member opposing to the arc tube, which is placed on the back surface side of the arc tube array.

These scan electrodes and address electrodes may be formed by using various materials and methods known in the corresponding field.

The present invention also relates to a driving method of the arc tube array-type display device in which, upon displaying an image on a screen, one frame constituted by a plurality of sub-fields having different luminances is used, with each sub-field being constituted by a reset period in which charges of all the light-emitting areas are initialized, an address period in which a light-emitting area to be allowed to emit light is selected and a sustain period in which the selected light-emitting area is made to emit light, and in this structure, during the reset period, a voltage pulse is applied to all the electrodes so that discharges are generated in all the light-emitting areas, during the address period, a scanning pulse is successively applied to the scan electrodes, while an address pulse is applied to desired address electrodes so that an address discharge is generated between each scan electrode and each address electrode, with a wall charge being accumulated within the light-emitting area to be made to emit light, and during the sustain period, a sustain pulse is alternately applied across the display electrodes opposing to each other with an arc tube being interposed in between so that a sustain discharge is generated within the arc tube to display an image on the screen, and this driving method of the arc tube array-type display device is characterized in that the reset period is constituted by a writing period and a charge compensating period, and during a writing period, discharges are generated respectively between the scan electrode and the address electrode as well as between the two display electrodes opposing to each other with the arc tube interposed in between so that a residual charge is eliminated while a new charge is formed, and during the charge compensating period, a discharge, used for setting the charge formed during the writing period to a state suitable for the next address discharge, is generated.

In this driving method, during the writing period, the voltage pulse to be applied across the scan electrode and address electrode and the voltage pulse to be applied across the two display electrodes are preferably set to voltages that respectively exceed a discharge starting voltage.

Upon applying a voltage pulse between the scan electrode and address electrode during this writing period, the voltage pulse to be applied to the scan electrode may be designed to have a blunt waveform. In this case, the "blunt waveform" refers to a voltage pulse whose wave-height value gradually rises. The degree of rise may be linear, or may correspond to a curved line (exponential function). Moreover, upon applying a voltage pulse between the two display electrodes during the writing period, the voltage pulse to be applied to one of the display electrodes may be designed to have a blunt waveform. In this case also, the "blunt waveform" refers to a voltage pulse whose wave-height value gradually rises. The degree of rise may be linear, or may correspond to a curved line (exponential function). Preferably, the voltage values of these blunt waveforms are set to a level of 1.5 to 3 times the respective static discharge starting voltages.

The voltage pulse to be applied during the charge compensating period is preferably constituted by a charge compensating pulse between the display electrodes, which generates a discharge between two display electrodes that oppose to each other with the arc tube being interposed in between, and a charge compensating pulse between the address and scan electrodes, which generates a discharge between the scan electrode and the address electrode.

The charge compensating pulse between the display electrodes and the charge compensating pulse between the address and scan electrodes may have blunt waveforms. In this case, the "blunt waveform" refers to a voltage pulse whose wave-height value gradually drops. The degree of drop may be linear, or may correspond to a curved line (exponential function).

The charge compensating pulse between the display electrodes is preferably allowed to proceed prior to the charge compensating pulse between the address and scan electrodes.

Moreover, upon applying the charge compensating pulse between the display electrodes, preferably, fixed potentials are preliminarily applied to the address electrode and the scan electrode respectively. The fixed potential to be applied to the address electrode has a wave-height value that is the same as the wave-height value of the address pulse, and the fixed potential to be applied to the scan electrode has a wave-height value that is the same as the wave-height value of the sustain pulse.

Upon successively applying the scan pulse to the scan electrodes during the address period, with the address pulse being applied to desired address electrodes during the corresponding period, preferably, fixed potentials are preliminarily applied to the display electrodes respectively that oppose to each other with the arc tube being interposed in between. In this case, each of the fixed potentials to be respectively applied to the display electrodes that oppose to each other with the arc tube being interposed in between is preferably set to a value that is higher than the wave-height value of the sustain pulse and is also lower than the discharge starting voltage between the two electrodes, and further preferably, this potential is also set to an electric potential which, when a discharge is generated between the address electrode and the scan electrode, is capable of generating a sustain discharge by using a charge formed through the discharge as a trigger.

Upon applying the sustain pulse alternately between the display electrodes that oppose to each other with the arc tube being interposed in between, preferably, fixed potentials are preliminarily applied to the scan electrode and the address electrode respectively.

In the arc tube array-type display device, the present invention aims to reduce the driving voltage and also to improve the light-emitting efficiency.

More specifically, a structure with four electrodes is prepared in which a scanning electrode (hereinafter, referred to as a scan electrode), an addressing electrode (hereinafter, referred to as an address electrode) and a pair of main electrodes for use in displaying (hereinafter, referred to as display electrodes) are placed at respective light-emitting areas of a single arc tube. Moreover, the paired display electrodes are placed on side walls of the arc tube, and the scan electrode is placed on the front surface side of the arc tube in a direction intersecting the length direction of the arc tube, with the address electrode being placed on the back surface side of the arc tube in parallel with the length direction of the arc tube. An address discharge is generated between the scan electrode and the address electrode so that by utilizing the resulting priming effect, a sustain discharge is generated between the paired display electrodes.

By utilizing the structure with four electrodes of this type, it becomes possible to provide all the discharges including the address discharge and the sustain discharge as opposing discharges. Since the sustain discharge (opposing discharge) is generated between the paired display electrodes placed on the side walls of the arc tube, the voltage of the sustain discharge can be lowered. Moreover, since the sustain discharge is generated near the phosphor layer, the phosphor exciting efficiency caused by vacuum ultraviolet rays becomes higher, making it possible to improve the light-emitting efficiency. Furthermore, since only one scan electrode is placed at each light-emitting area on the display surface, the light-shielding rate due to electrodes can be lowered in comparison with an arc tube array-type display device of a face discharge type, thereby improving the light-emitting efficiency.

The following description will discuss the present invention in detail based upon embodiments illustrated in Figures. Here, the present invention is not intended to be limited by these, and various modifications may be made therein.

FIG. 1 is an explanatory drawing that shows the entire structure of an arc tube array-type display device of the present invention. This display device 10 is an arc tube array-type display device in which a plurality of arc tubes, each having a structure in which a phosphor layer is placed inside a thin tube made of glass, having 0.5 to 5 mm in diameter, with a discharge gas sealed therein, are arranged in parallel with one another so as to display a desired image.

In this Figure, reference numeral 31 represents a supporting member (substrate) on the front surface side (display surface side), 32 represents a supporting member (substrate) on the back surface side, 1 represents an arc tube, S represents a scan electrode, X and Y represent display electrodes, and A represents an address electrode.

The arc tube array-type display device has a structure in which: a plurality of arc tubes 1 are arranged in parallel with one another to form an arc tube array and the arc tube array is sandwiched between the supporting member 31 on the front surface side and the supporting member 32 on the back surface side.

The supporting member 31 on the front surface side and the supporting member 32 on the back surface side are made of flexible sheets such as PET films. The supporting member 31 on the front surface side is transparent. The supporting member 32 on the back surface side is preferably made to be opaque from the viewpoint of display contrast. The tube member of the arc tube 1 is made from borosilicate glass or the like.

A plurality of scan electrodes S are formed on the face opposing to the arc tubes of the supporting member 31 on the front surface side. The scan electrodes S are formed in a direction intersecting the address electrode A so as to be made in contact with the arc tube 1. Each of the scan electrodes S is constituted by a transparent electrode made from ITO, $SnO_2$ or the like and a bus electrode made of metal such as nickel, copper, aluminum and chromium. In addition, the scan electrode S may be prepared as an electrode that is made from only the metal electrode without using the transparent electrode.

The address electrode A is formed on the face opposing to the arc tube of the supporting member 32 on the back surface side. The address electrode A is formed along the length direction of the arc tube 1 so as to be made in contact with the arc tube 1. The address electrode A is made of metal such as nickel, copper, aluminum and silver.

The display electrodes X and Y are placed between the arc tubes 1. The display electrodes X and Y, made of metal such as nickel, copper, aluminum and silver, are directly formed on the outside wall faces of the arc tube by using a method, such as a sputtering method, a vapor deposition method, a plating method and a printing method.

In this manner, in the present arc tube array-type display device, the scan electrodes S are arranged on the front surface side of the arc tube 1, the address electrode A is placed on the back surface side of the arc tube 1, and the display electrodes X and Y are placed on the side faces of the arc tube 1. The scan electrodes S and the address electrode A are arranged to be orthogonal to each other in the plan view of the display device so that each intersecting portion between the address electrode A and the scan electrode S forms a unit light-emitting area (unit discharging area). Therefore, the electrode structure of the present arc tube array-type display device is referred to as a four-electrode structure in which the scan electrode S, the address electrode A and the display electrodes X and Y are arranged on a single light-emitting area.

The displaying operation is carried out in the following manner: a light-emitting area is selected while an address discharge is being generated at the intersecting portion between the scan electrode S and the address electrode A, and by utilizing a wall charge formed on the tube inner face of the corresponding area by the address discharge, a sustain discharge is generated across the display electrodes X and Y. The address discharge is an opposing discharge generated inside the arc tube 1 between the scan electrode S and the address electrode A, and the sustain discharge is an opposing discharge generated inside the arc tube 1 between the display electrodes X and Y placed on the side faces of the arc tube 1.

Figure 2:
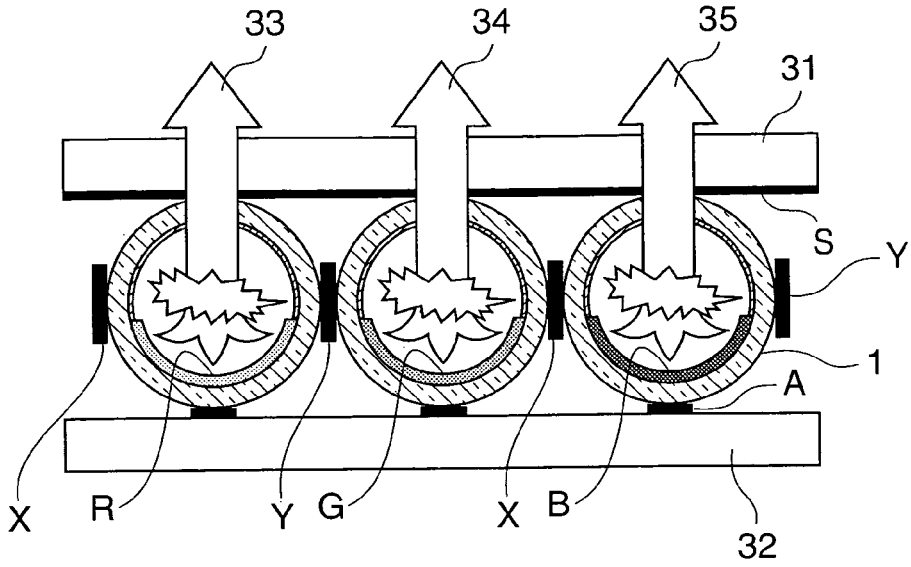
FIG. 2 is a sectional view that shows the arc tube array-type display device shown in FIG. 1.

FIG. 2 is an explanatory drawing that shows a cross-section of the arc tube array-type display device. This Figure shows a cross-section that is orthogonal to the length direction of the arc tube.

The tube member of the arc tube 1 is formed by using a thin tube made of glass. This thin tube has a round section, and is formed by using Pyrex (registered trademark: heat resistant glass made by U.S. Corning Inc.), with a tube diameter of 0.7 to 1.5 mm, a tube thickness of 0.07 to 0.1 mm and a length of 220 to 300 mm.

This thin tube, which forms a tube member of the arc tube 1, is formed in the following manner: a cylindrical tube is formed by using a Danner* method, and the cylindrical tube is heated and molded into a glass base material having a symmetric shape to the thin tube to be produced, and this is then redrawn (extended) while being heated and softened.

Phosphor layers are placed on the back surface side for the respective colors of R (red), G (green) and B (blue) in a discharging space inside the arc tube 1, and a discharge gas containing neon and xenon is introduced thereto; thus, the two ends are sealed so that the discharging space is formed inside the arc tube.

Upon displaying, red light 33, green light 34 and blue light 35 are emitted from the arc tubes 1, and these three arc tubes, which are adjacent to one another and used for R, G and B colors, form a set so as to provide one pixel. With respect to the inner structure of the arc tube, structures known in the corresponding field, such as a structure described in Japanese Patent Application Laid-Open No. 2003-86142, may be used.

Instead of directly forming the display electrodes X and Y on the outside wall faces of the arc tube, electrodes are formed on the two faces of a resin sheet or the like through a low-temperature sputtering method, a printing method or the like, and this may be sandwiched between the arc tubes as the display electrodes X and Y, and made in contact with the side faces of the arc tube. However, since these display electrodes increase the contact area with the arc tube, it is preferable to directly form the display electrodes onto the arc tube.

FIG. 2 has exemplified a structure in which one display electrode is commonly possessed by the adjacent arc tubes; however, the respective display electrodes may be formed on the outside wall face of the arc tube. In this case, the display electrodes of the adjacent arc tubes are made in contact with each other; therefore, upon carrying out a sustain discharge, with respect to the two adjacent display electrodes that are made in contact with each other, they are made to have the same polarity, and subjected to the voltage application.

Figure 3:
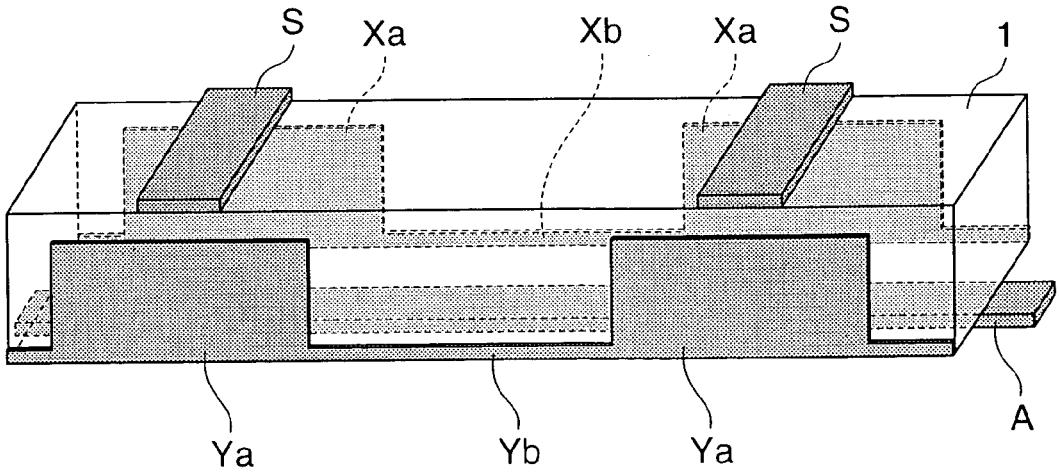
FIG. 3 is an explanatory drawing that shows a structural example of electrodes.

FIG. 3 is an explanatory drawing that shows a structural example of the electrode. This Figure shows only one arc tube.

The arc tube of the present embodiment has a rectangular shape in its cross-section; however, not limited to this shape, the arc tube may have any shape, such as a round shape, an elliptical shape, a rectangular shape and a trapezoidal shape, in its cross-section.

The scan electrode S is formed on the supporting member on the front surface side, and the address electrode A is formed on the supporting member on the back surface side. The display electrodes X and Y are directly formed on the side faces of the arc tube 1.

With respect to the portion of the light-emitting area at the intersecting portion between the scan electrode S and the address electrode A, the display electrodes X and Y are prepared as thick electrode portions Xa and Ya so as to improve the discharging characteristic, and with respect to the portions other than the light-emitting area, they are prepared as thin electrode portions Xb and Yb. The thick electrode portions Xa and Ya are formed on the center portions of the outside wall faces of the arc tube. The thin electrode portions Xb and Yb are formed at positions close to the back surface side of the outside wall faces of the arc tube.

In this manner, the two display electrodes X and Y are periodically changed in the widths of the electrodes so as to separate the light-emitting areas (light-emitting cells) so that the thick electrode portions Xa and Ya are aligned face to face with each other. This arrangement is formed so as to define the light-emitting areas by utilizing the fact that the discharge voltage differs depending on the area at which the electrodes oppose to each other.

FIGS. 4 to 9 are explanatory drawings that show pattern examples of the display electrode.

Figure 4:
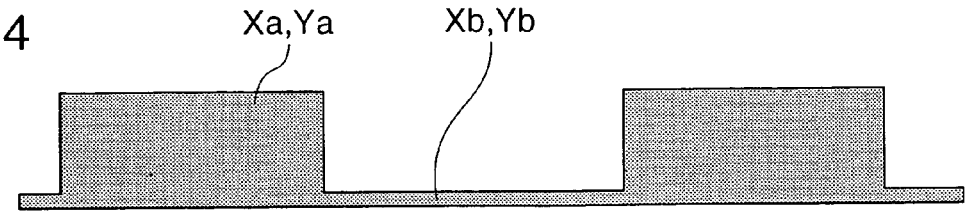
FIG. 4 is an explanatory drawing that shows an example of a pattern of display electrodes.

An electrode pattern shown in FIG. 4 is a basic pattern in which the portion of a discharging area, that is, the thick electrode portions Xa and Ya, is formed by a solid metal film. The thin electrode portions Xb and Yb have all the same pattern with respect to FIGS. 4 to 9.

Figure 5:
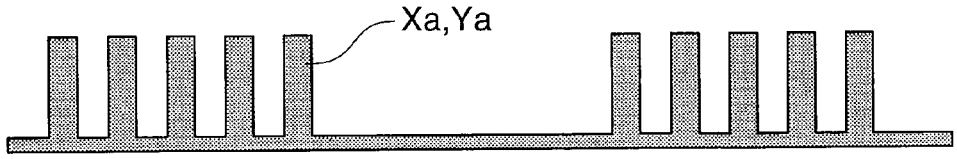
FIG. 5 is an explanatory drawing that shows another example of the pattern of display electrodes.

In an electrode pattern shown in FIG. 5, the thick electrode portions Xa and Ya are formed into a comb shape. In an electrode pattern shown in FIG. 6, the thick electrode portions Xa and Ya are formed into a ladder shape.

Figure 6:
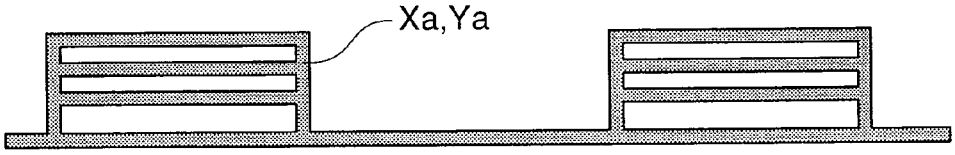
FIG. 6 is an explanatory drawing that shows still another example of the pattern of display electrodes.
Figure 7:
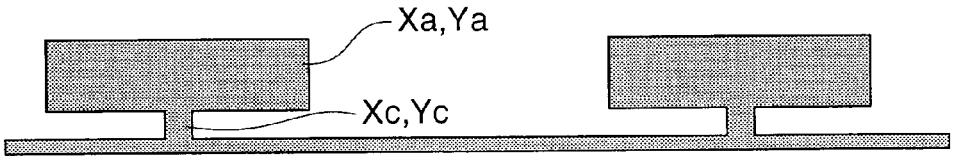
FIG. 7 is an explanatory drawing that shows still another example of the pattern of display electrodes.
Figure 8:
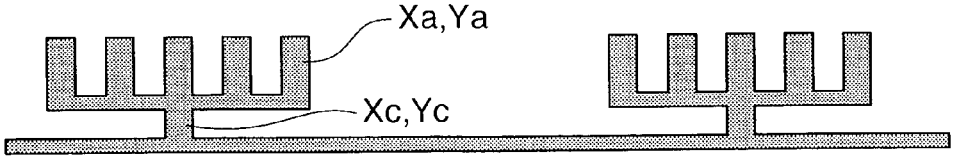
FIG. 8 is an explanatory drawing that shows still another example of the pattern of display electrodes.

In electrode patterns shown in FIGS. 7 and 8 that are modified examples of the electrode patterns shown in FIGS. 4 to 6, connecting portions Xc and Yc that couple the thick electrode portions Xa and Ya to the thin electrode portions Xb and Yb are installed.

Figure 9:
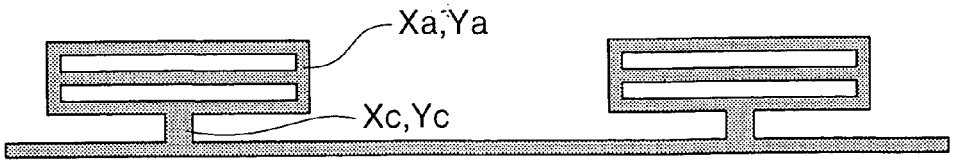
FIG. 9 is an explanatory drawing that shows the other example of the pattern of display electrodes.

In FIG. 7, the thick electrode portions Xa and Ya are formed by a solid metal film; in FIG. 8, the thick electrode portions Xa and Ya are formed into a comb shape; and in FIG. 9, the thick electrode portions Xa and Ya are formed into a ladder shape.

In comparison with the electrode pattern of FIG. 4, the electrode patterns of FIGS. 5 and 6 are adopted from the viewpoints of reducing an electrostatic capacitance, reducing a discharging current, improving a light-emitting efficiency, improving an operating margin and the like. In comparison with the electrode pattern of FIG. 7, the electrode patterns of FIGS. 8 and 9 are also adopted from the viewpoints of reducing an electrostatic capacitance, reducing a discharging current, improving a light-emitting efficiency, improving an operating margin and the like.

Not limited to the above-mentioned example, the thick electrode portions Xa and Ya of the display electrodes X and Y may have any shape as long as the area thereof is greater than that of the thin electrode portions Xb and Yb.

Figure 10:
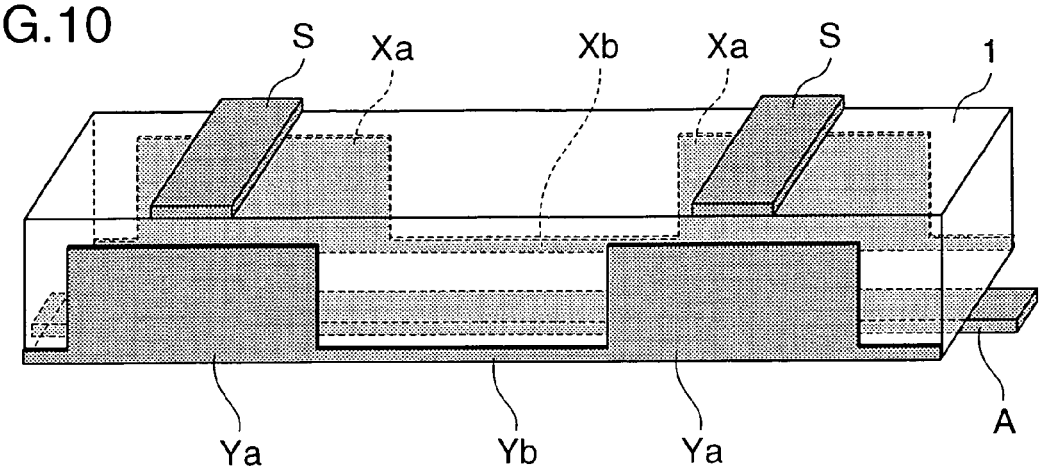
FIG. 10 is an explanatory drawing that shows an example of a pattern of scan electrodes.
Figure 11:
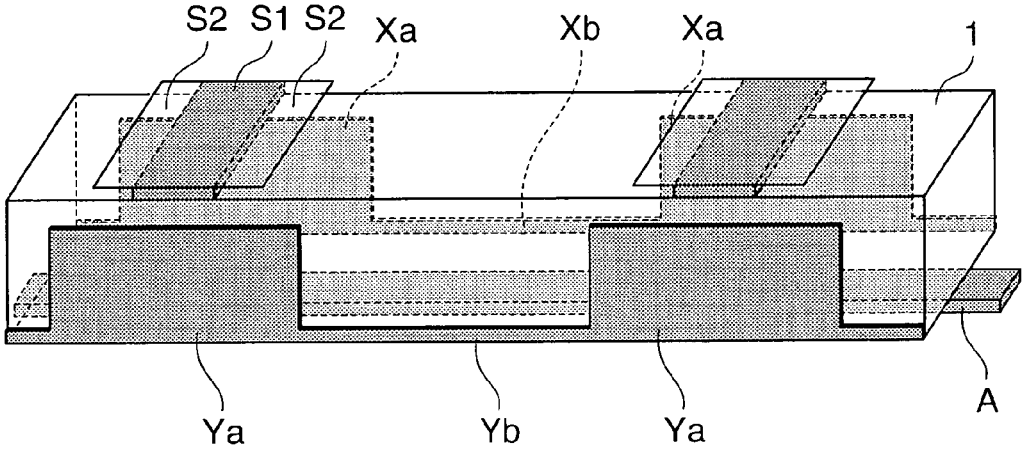
FIG. 11 is an explanatory drawing that shows another example of the pattern of scan electrodes.
Figure 12:
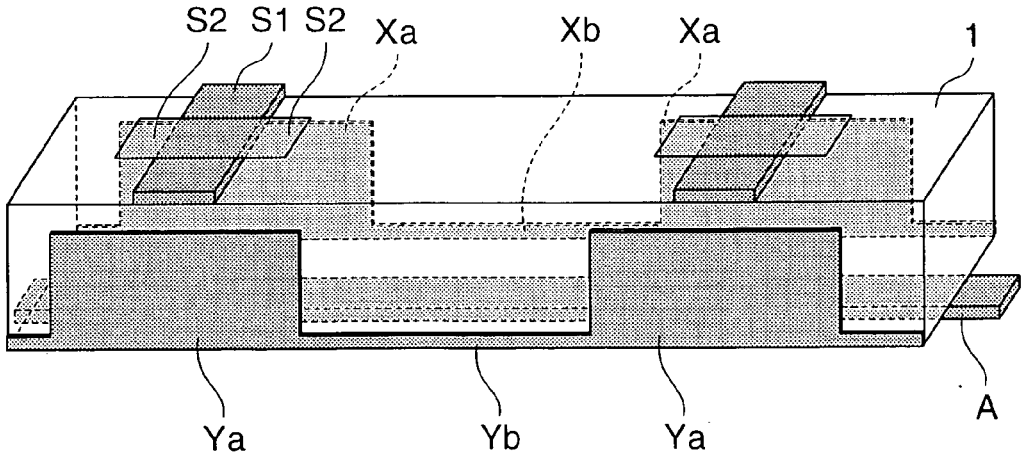
FIG. 12 is an explanatory drawing that shows the other example of the pattern of scan electrodes.

FIGS. 10 to 12 are explanatory drawings that show pattern examples of the scan electrode.

The scan electrode S is located on the front surface side of the arc tube array; therefore, as the light-shielding rate thereof becomes lower, it becomes possible to obtain a higher luminance. For this reason, the width of the electrode is made as narrow as possible. However, when the width of the electrode becomes narrower, the area at the intersecting portion between the scan electrode S and the address electrode A becomes smaller, resulting in an increase in the discharge starting voltage and a reduction in the discharging probability. In order to solve this problem, the scan electrode S is preferably constituted by a transparent electrode, made of an ITO film, an $SnO_2$ film or the like, having a wide width, and a bus electrode, made of a metal film, having a narrow width.

FIG. 10 shows an example in which the scan electrode S is formed by using only the metal film. FIGS. 11 and 12 show examples in which the scan electrode S is formed by using a bus electrode S 1 and a transparent electrode S2. The difference between these FIGS. 11 and 12 is that the transparent electrode S2 is formed on the entire scan electrode in FIG. 11, while the transparent electrode S2 is formed only on the light-emitting area in FIG. 12.

In the case when the transparent electrode S2 is formed only on the light-emitting area, it is possible to reduce an electrostatic capacitance in comparison with the case in which the transparent electrode S2 is formed on the entire portion.

Since the intersecting portion between the scan electrodes and the address electrode A forms the light-emitting area, it is preferable to make the portion corresponding the light-emitting area wider than the other portion with respect to the address electrode A as well.

In this manner, by using a sustain discharge as the opposing discharge with the display electrode being attached to the outside wall face of the arc tube, the number of the scan electrodes is limited to one at one portion of the light-emitting area so that it becomes possible to provide a display device that has a low discharge starting voltage and a low light-shielding rate, and consequently exerts a superior light-emitting efficiency with a high luminance, in comparison with an arc tube array-type display device of a type in which a face discharge is generated between display electrodes.

The following description will discuss a driving method of the arc tube array-type display device of the present invention.

The driving method of the present invention is a driving method of the above-mentioned arc tube array-type display device of a four-electrode structure, which utilizes the advantages of the specific structure of the arc tube and a reduced discharge starting voltage in the opposing discharge. With this arrangement, the problems with the arc tube array-type display device of the type in which the sustain discharge is generated as a face discharge, that is, a high driving voltage and a reduction of the light-emitting efficiency due to a high shielding rate, can be solved.

In other words, in the present driving method, an address discharge is generated between the scan electrode S and the address electrode A, and by utilizing its priming effect, a sustain discharge is generated between the two display electrodes X and Y formed on the outside wall faces of the arc tube. By using this driving method, it becomes possible to provide all the discharges including the address discharge and the sustain discharge as opposing discharges. In the case when a sustain discharge is provided between the electrodes formed on the outside wall faces of the arc tube, the discharge starting voltage is lowered because of the opposing discharge, and since the discharge is generated in the vicinity of the phosphor layer, the phosphor exciting efficiency caused by vacuum ultraviolet rays becomes higher so that the light-emitting efficiency is improved. Moreover, since only one scan electrode S is formed on the display surface for each unit of light-emitting areas, the light-shielding rate can be reduced in comparison with an arc tube array-type display device of the face discharge type, making it possible to increase the light-emitting efficiency by utilizing the reduced light-shielding rate.

The following description will discuss the present driving method in detail.

Upon displaying an image on a screen, one frame constituted by a plurality of sub-fields having different luminances is used, with each sub-field being constituted by a reset period in which charges of all the light-emitting areas are initialized, an address period in which a light-emitting area to be allowed to emit light is selected and a sustain period in which the selected light-emitting area is made to emit light.

Moreover, during the reset period, a voltage pulse is applied to all the electrodes so that discharges are generated in all the light-emitting areas. During the address period, a scanning pulse is successively applied to the scan electrodes S, while an address pulse is applied to desired address electrodes A so that an address discharge is generated between each scan electrode S and each address electrode A, with a wall charge being accumulated within the light-emitting area to be made to emit light. During the sustain period, a sustain pulse is alternately applied across the display electrodes X and Y opposing to each other with an arc tube being interposed in between so that a sustain discharge is again generated within the light-emitting area in which the wall charge has been accumulated to allow the light-emitting area to emit light. The light emission in the light-emitting area is carried out by exciting a phosphor material with ultraviolet rays generated by the sustain discharge so as to allow the phosphor material to generate a visible light ray with a desired color.

Figure 13:
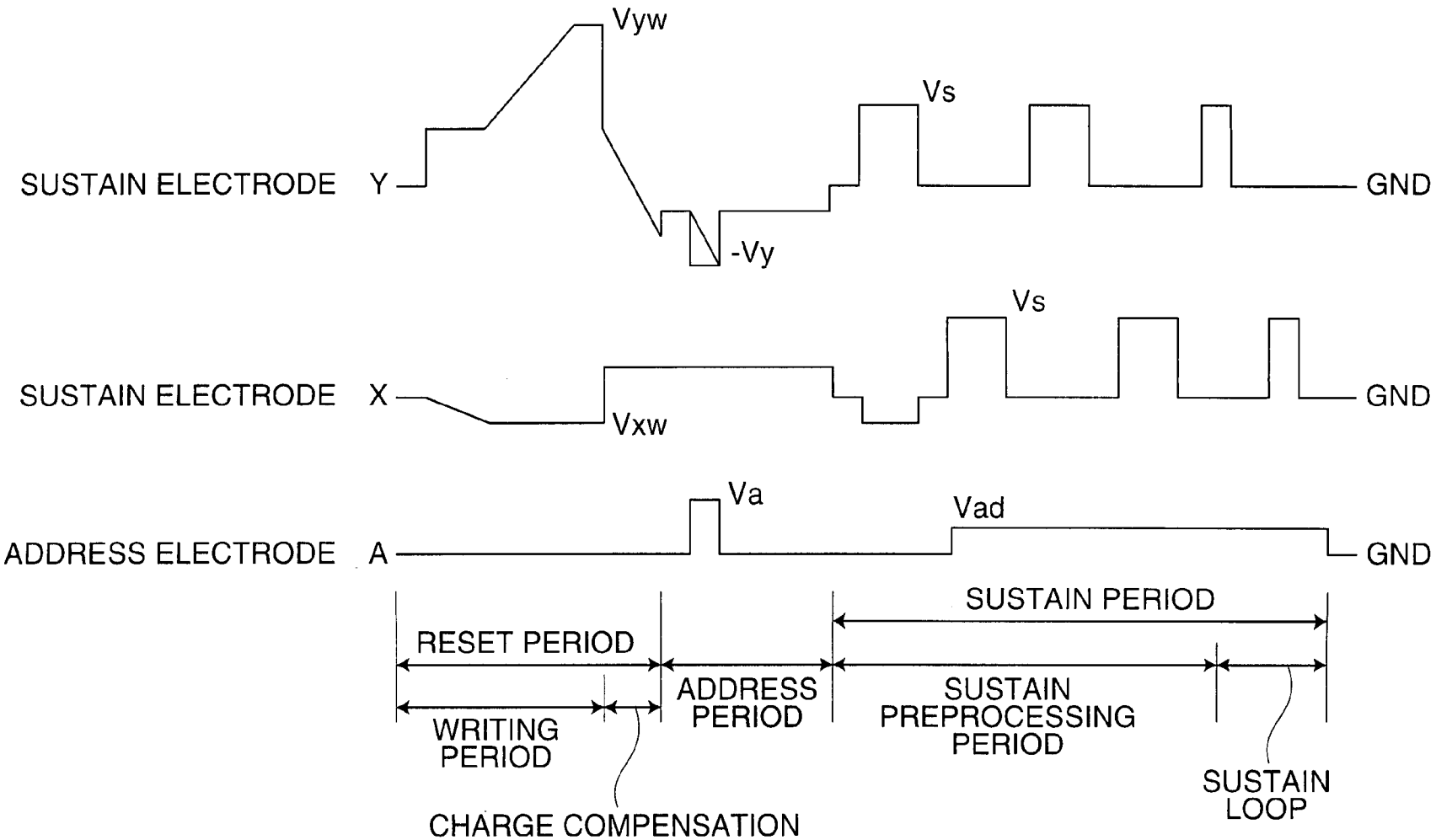
FIG. 13 is an explanatory drawing that shows a comparative example of a driving method.
Figure 17:
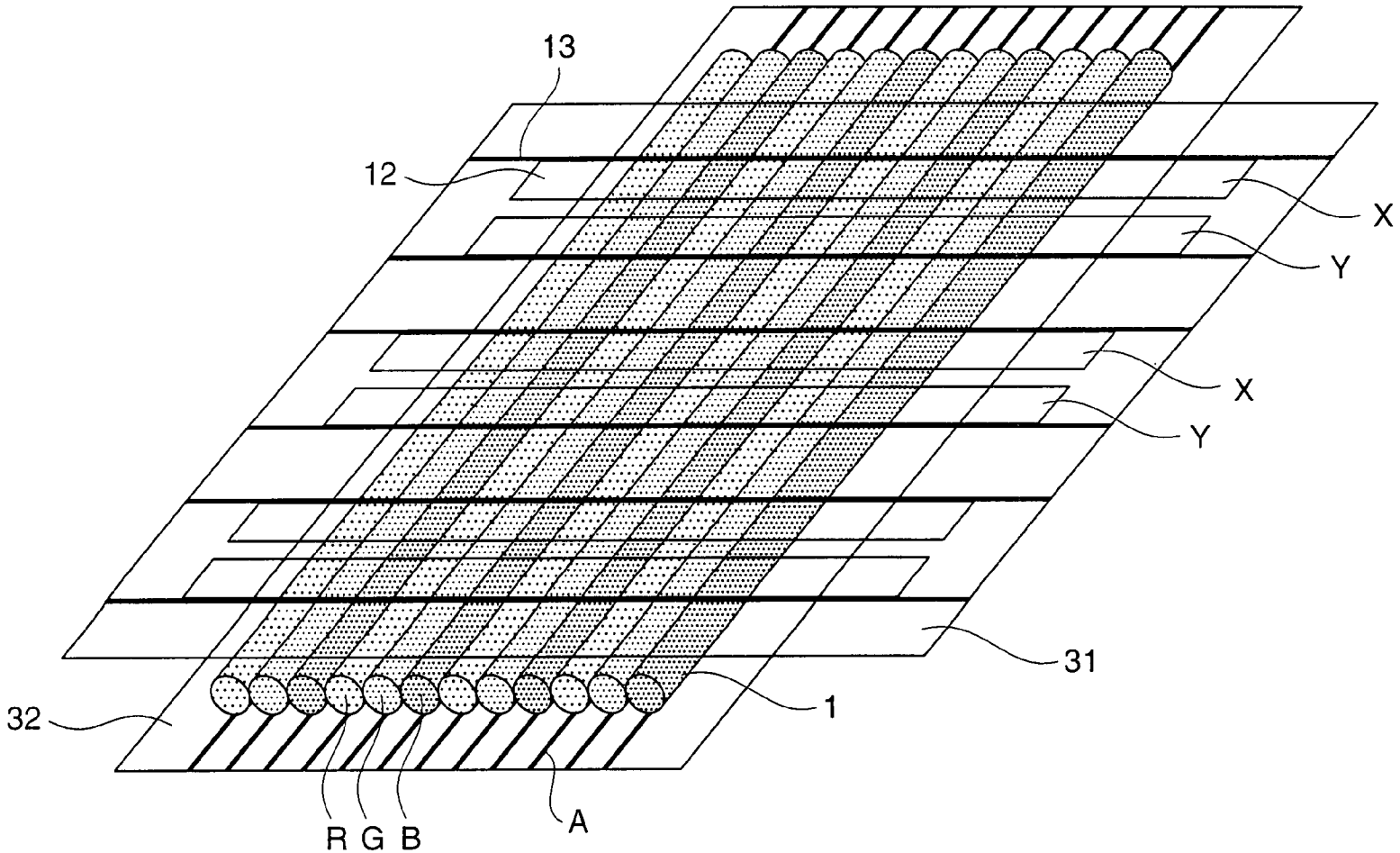
FIG. 17 is a perspective view that shows the entire structure of a conventional arc tube array-type display device of a face discharge type.
Figure 18:
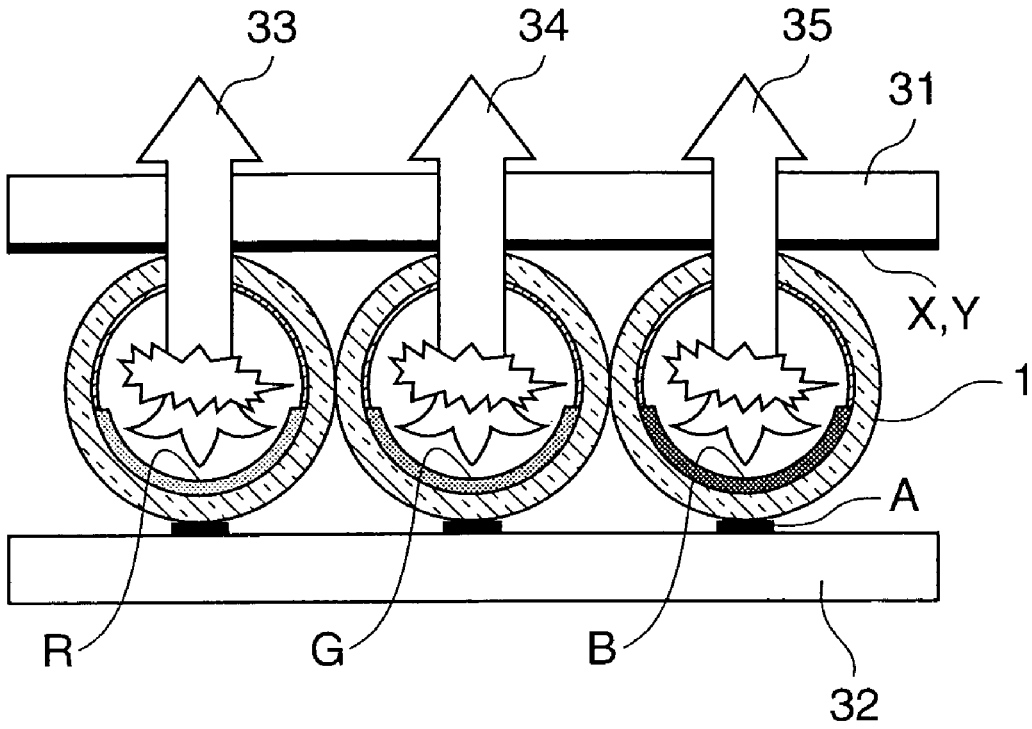
FIG. 18 is a partial sectional view of the arc tube array-type display device of FIG. 17.

FIG. 13 is an explanatory drawing that shows a comparative example of the driving method. This Figure shows driving waveforms of the arc tube array-type display device of the face discharge type shown in FIGS. 17 and 18. The driving waveform shown in this Figure indicates a period of one sub-field.

Different from the driving method of the present invention, the driving method of this comparative example has an arrangement in which: a reset discharge is generated between the display electrodes X and Y during the reset period, an address discharge is generated between the address electrode A and the display electrode Y during the address period, and a sustain discharge is generated between the display electrodes X and Y during the sustain period.

Figure 14:
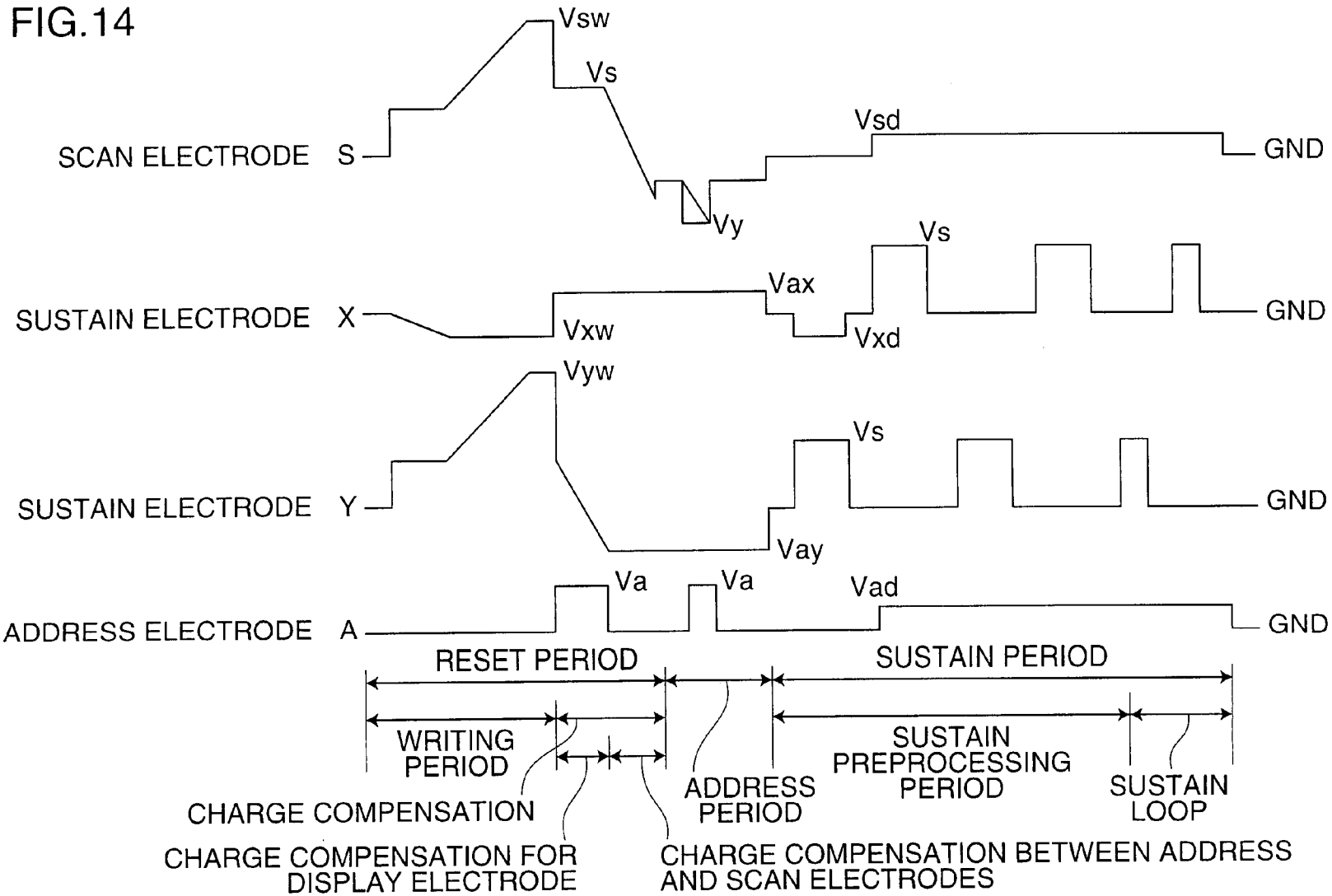
FIG. 14 is an explanatory drawing that shows an example of a basic driving waveform of a driving method of the present invention.

FIG. 14 is an explanatory drawing that shows one example of a basic driving waveform of the driving method of the present invention.

Since the present driving method relates to a driving method of an arc tube array-type display device having a four-electrode structure, a specific device for this structure is required. The following description will discuss the device in detail.

The driving waveform is mainly divided into three steps, that is, a reset period, an address period and a sustain period, and the reset period is further constituted by a writing period and a charge compensating period, and the sustain period is further constituted by a sustain preprocessing period and a sustain loop. The following description will discuss voltages to be applied during the respective periods.

(1) Reset Period (a) Writing Period

In a writing period, it is aimed that a discharge is generated in all the light-emitting areas irrespective of a state of residual charge in the sustain period in the previous sub-field.

Because of the four-electrode structure, writing discharges need to be carried out depending on the roles of the four electrodes. Here, the electrodes are divided into a set of two display electrodes X and Y that provides a sustain discharge and a set of the scan electrode S and the address electrode A that provides an address discharge. For this reason, voltage pulses are applied to the sets of electrodes respectively in a manner so as to exceed the respective discharge starting voltages.

During the next address period, preferably, a minus charge is accumulated on the scan electrode S and a plus charge is accumulated on the address electrode A. Therefore, a plus writing pulse is applied onto the scan electrode S. Moreover, during the next address period, plus and minus charges also need to be accumulated onto the respective two display electrodes X and Y. Therefore, a plus writing pulse is applied to either one of the display electrodes. The values of voltages to be applied are set so as to satisfy the following conditions:

$$Vsw > Vfs-a$$

$$|Vxw|+|Vyw| > Vfx-y$$

In these expressions, Vsw indicates a voltage to be applied to the scan electrode S, and Vfs−a indicates a discharge starting voltage to be applied across the scan-address electrodes. Moreover, Vxw indicates a voltage to be applied to the display electrode X, Vyw indicates a voltage to be applied to the display electrode Y, and Vfx−y indicates a discharge starting voltage to be applied across the display electrodes X and Y.

The voltage Vsw to be applied to the scan electrode S during the writing period and the voltage Vyw to be applied to the display electrode Y have blunt waveforms, and are allowed to rise linearly.

When the writing voltage waveform is prepared as a blunt waveform, the sum |Vxw|+|Vyw| of the absolute values of the voltage Vxw to be applied to the display electrode X and the voltage Vyw to be applied to the display electrode Y is preferably set to a value that is about 1.5 to 3 times the respective static discharge starting voltages.

(b) Charge-Compensating Period

After the writing period, the charge is set to a state suitable for the address discharging during this charge-compensating period. The charge-compensating period is further re-divided so that a charge-compensating process of the display electrodes for generating a discharge across the display electrodes X and Y and a charge compensating process between the address-scan electrodes for generating a discharge between the address electrode A and the scan electrode S are carried out in a divided manner.

In this case, it is necessary to provide an arrangement in which even when a semi-selection pulse (to be applied to each of Va, Vy Vsc independently) is applied during an address period, no erroneous discharge is generated. More specifically, the arrangement is made so that, even when a voltage Va is applied to the address electrode A, no erroneous discharge is generated between the address electrode A and the display electrode X (or Y) having a minus charge. For this reason, after a fixed potential corresponding to a voltage Va has been applied to the address electrode A, the charge-compensating discharging process is carried out across the display electrodes X and Y.

Moreover, it is necessary to provide an arrangement in which upon carrying out a sustain discharge, no erroneous discharge is generated at the light-emitting areas that have not been subjected to the address discharge. For this reason, the reachable electric potential of the charge-compensating discharge across the display electrodes X and Y needs to be set to a value that is greater than the applied voltage Vs at the time of the sustain discharge. Therefore, the values of voltages to be applied are set so as to satisfy the following condition:

$$|Vax|+|Vay| \geqq Vs$$

In this expression, Vax indicates a voltage to be applied to the display electrode X, and Vay indicates a voltage to be applied to the display electrode Y.

Here, it is necessary to keep the electric potential of the scan electrode S high during the charge-compensating period; however, in order to reduce the number of power sources, the scan electrode S may be kept at the voltage Vsw as it is, or may be set to the voltage Vs at the time of the sustain discharge.

(2) Address Period

During an address period, an address discharge is generated between the address electrode A and the scan electrode S, and by using this discharge as a trigger, a quantity of charge capable of generating a sustain discharge across the display electrodes X and Y is formed in the light-emitting area.

(3) Sustain Period

A sustain period is divided into a sustain preprocessing period and a sustain loop in which a discharge is repeated. During the sustain preprocessing period, since a wall charge formed through the address discharge is unstable, the charge is shape-adjusted so as to carry out a stable sustain discharge. For this reason, the leading pulse is formed by adding a voltage Vxd in addition to the voltage Vs so as to positively generate a discharge. Moreover, it is preferable to apply several voltage pulses having a pulse width greater than the pulse width in the sustain loop prior to the start of the sustain loop.

Figure 15:
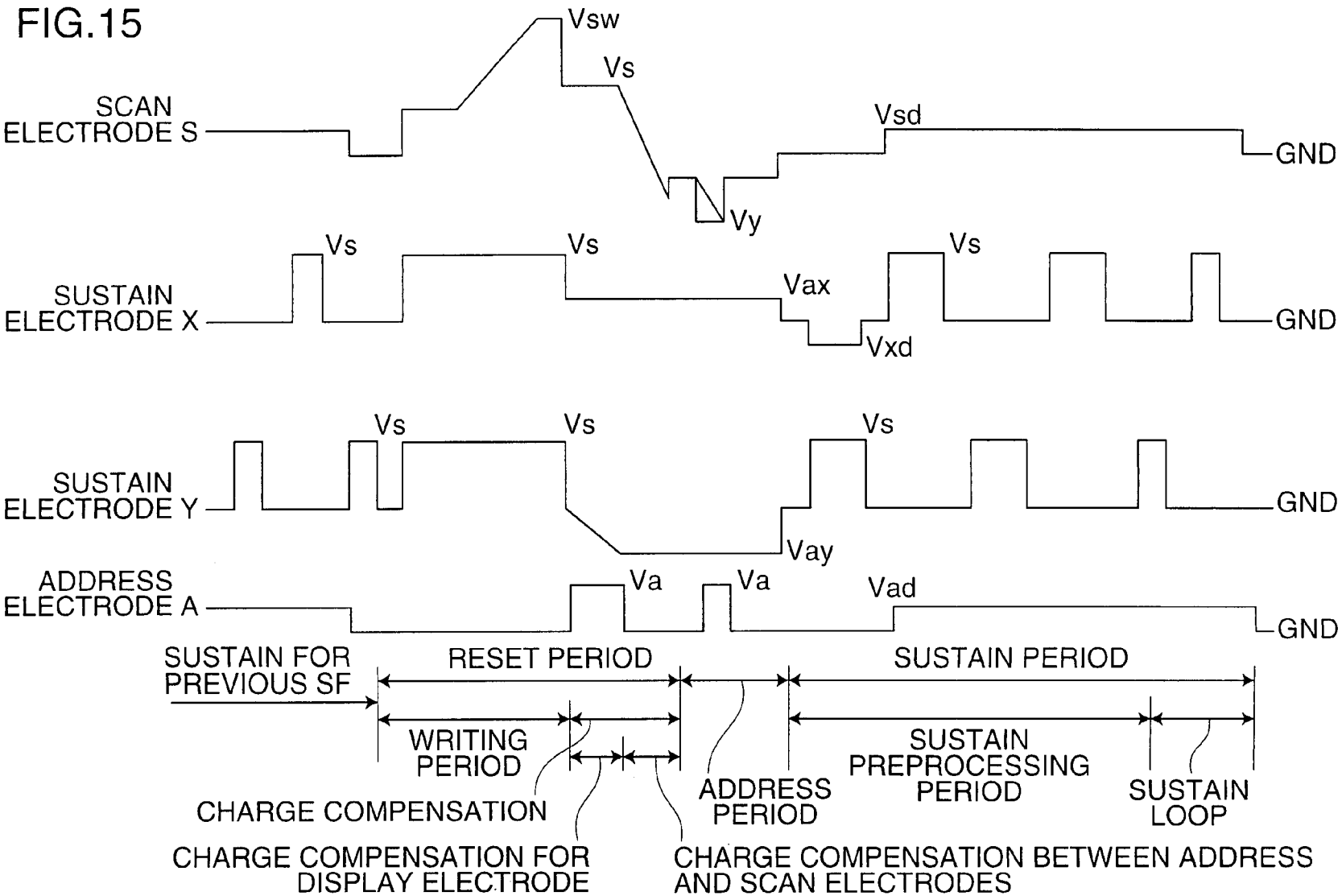
FIG. 15 is an explanatory drawing that shows another example of the driving waveform of the driving method of the present invention.

FIG. 15 is an explanatory drawing that shows another example of a driving waveform of the driving method of the present invention.

In this driving waveform, no writing discharge is generated across the display electrodes X and Y during the reset period, and it is the premise that the residual charge caused by a light emission in the previous sub-field is utilized. For this reason, although the driving waveform may be utilized independently, the driving waveform of FIG. 14 is adopted in the leading sub-field in one frame, when one frame is constituted by a plurality of sub-frames so as to carry out a displaying process, and the present driving waveform may be adopted in the sub-fields of the second sub-field and thereafter.

Since the residual charge in the previous sub-field is utilized, a writing discharge is generated only between the scan electrode S and the address electrode A during the writing period. In this case, a pulse having the same polarity as the writing pulse is applied to the display electrodes X and Y, so as not to generate an erroneous discharge between the scan electrode S and the display electrode X (or Y). In the charge-compensating period and thereafter, the same operations as those in the driving waveform of FIG. 14 are carried out.

Figure 16:
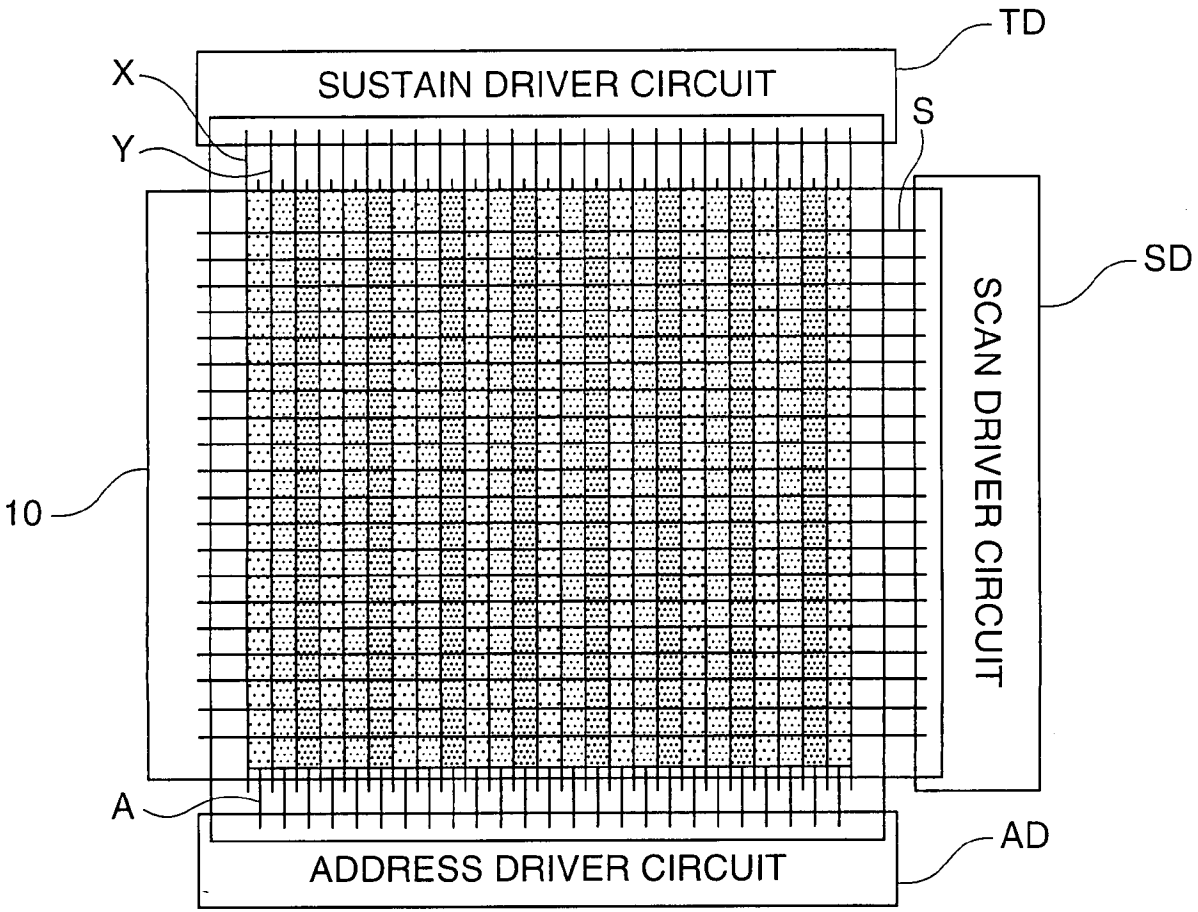
FIG. 16 is an explanatory drawing that shows an example of a layout of a driving circuit.

FIG. 16 is an explanatory drawing that shows one example of a layout of a driving circuit.

In this layout, a scan driver SD used for the scan electrode S is placed beside an arc tube array-type display device 10, an address driver AD used for the address electrode A is placed below it, and a sustain driver TD used for the display electrodes X and Y is placed above it, respectively. Since the address electrode A, the scan electrode S and the display electrodes X and Y are completely independent, exclusively-used substrates can be formed respectively so that measures to prevent mutual interferences of noise and the like and heat-preventive measures can be easily taken.

The invention claimed is:

1. An arc tube array-type display device comprising:

an arc tube array in which a plurality of arc tubes are arranged side by side, each of the arc tubes having a discharging gas sealed therein;

a supporting member that is made in contact with at least one of a display surface side and a back surface side of the arc tube array so as to support the arc tube array;

a plurality of display electrodes that are arranged at an adjacent portion between the arc tubes, and generate an opposing discharge inside the arc tube by applying voltages to each of the arc tubes from both of the adjacent portions;

a plurality of scan electrodes that are arranged on the display surface side of the arc tube in a stripe form in a direction intersecting the longitudinal direction of the arc tube so as to form light-emitting areas at intersecting portions against the arc tubes; and a plurality of address electrodes used for selecting light-emitting areas arranged on the back surface side of the respective arc tubes, wherein each of the display electrodes comprises light-emitting and non-light-emitting areas, the light-emitting areas being wider than the non-light-emitting areas and the non-light-emitting areas being formed on a position close to the back surface of the arc tube array, each of the address electrodes comprises light-emitting and non-light-emitting areas, the light-emitting areas being wider than the non-light-emitting areas, and the light-emitting areas of the display electrodes project from the supporting member.

2. The arc tube array-type display device according to claim 1, wherein the display electrodes are formed on both sides in the outside wall face of the arc tube.

3. The arc tube array-type display device according to claim 1, wherein each of the display electrodes is formed on one of both sides in the outside wall face of the arc tube, and the adjacent arc tubes commonly possess each of the display electrodes located between the adjacent arc tubes.

4. The arc tube array-type display device according to claim 1, wherein the supporting member is constituted by a front-surface side supporting member placed on the display surface side of the arc tube array and a back-surface side supporting member placed on the back surface side of the arc tube array, the scan electrodes are formed on a face opposing to the arc tube of the front-surface side supporting member, and the address electrodes are formed on a face opposing to the arc tube of the back-surface side supporting member.

* * * * *